US009101970B2

(12) United States Patent
Shimai

(10) Patent No.: US 9,101,970 B2
(45) Date of Patent: Aug. 11, 2015

(54) GROOVE PROCESSING DEVICE AND GROOVE PROCESSING METHOD

(75) Inventor: Kenichi Shimai, Gyoda (JP)

(73) Assignee: SHOWA CORPORATION, Saitama (JP)

( * ) Notice: Subject to any disclaimer, the term of this patent is extended or adjusted under 35 U.S.C. 154(b) by 583 days.

(21) Appl. No.: 13/527,297

(22) Filed: Jun. 19, 2012

(65) Prior Publication Data

US 2013/0086968 A1 Apr. 11, 2013

(30) Foreign Application Priority Data

Oct. 7, 2011 (JP) ..... 2011-223064

(51) Int. Cl.

| | |
|---|---|
| ***B21D 15/02*** | (2006.01) |
| ***B21C 37/20*** | (2006.01) |
| ***B21J 5/12*** | (2006.01) |
| ***B21D 13/04*** | (2006.01) |
| ***B21D 17/04*** | (2006.01) |

(52) U.S. Cl.

CPC ..... *B21D 15/02* (2013.01); *B21C 37/202* (2013.01); *B21D 13/04* (2013.01); *B21D 17/04* (2013.01); *B21J 5/12* (2013.01)

(58) Field of Classification Search

CPC ..... B21D 17/00; B21D 17/04; B21D 15/02; B21D 13/04; B21C 37/202; B21J 5/12

USPC ..... 72/115, 180, 370.06, 370.21, 75, 208, 72/214, 113, 116, 117, 370.04, 51, 211, 72/225, 226, 181, 235; 29/55

See application file for complete search history.

(56) References Cited

U.S. PATENT DOCUMENTS

| | | | | |
|---|---|---|---|---|
| 4,643,011 | A | 2/1987 | Wossner et al. | |
| 7,222,509 | B2 * | 5/2007 | Tsuda et al. | 72/113 |
| 2009/0320545 | A1 * | 12/2009 | Robins | 72/181 |

FOREIGN PATENT DOCUMENTS

| | | | |
|---|---|---|---|
| GB | 2280628 | A | 2/1995 |
| JP | S43-014120 | B | 6/1968 |
| JP | H09-206877 | | 8/1997 |
| JP | 2009-229123 | A | 9/1997 |

* cited by examiner

*Primary Examiner* — David B Jones
(74) *Attorney, Agent, or Firm* — Leason Ellis LLP

(57) ABSTRACT

A groove processing device, which processes a cylinder groove to an inner circumference of a cylinder to protrude from an inner circumferential surface toward an outer circumferential surface side and extend in a center line direction of the cylinder, includes: a first groove processing unit that process both end portions of the cylinder groove in a circumferential direction thereof, and a second groove processing unit that processes a center portion of the cylinder groove in the circumferential direction thereof, wherein an outermost circumferential portion of each of the first groove processing unit and the second groove processing unit being formed to be a chevron shape so that a center portion thereof in the circumferential direction of the cylinder protrudes, and an inclination angle from a vertex portion in the outermost circumferential portion of the first groove processing unit is larger than that of the second groove processing unit.

2 Claims, 12 Drawing Sheets

GROOVE PROCESSING DEVICE AND GROOVE PROCESSING METHOD

CROSS REFERENCE TO RELATED APPLICATIONS

This application is based on and claims priority under 35 USC §119 from Japanese Patent Application No. 2011-223064 filed Oct. 7, 2011.

BACKGROUND

1. Technical Field

The present invention relates to a groove processing device and a groove processing method.

2. Related Art

A vehicle is provided with a gas cylinder apparatus between a door and a body thereof for reducing a force required by a user to open the door.

The gas cylinder apparatus includes a piston that slides within a cylinder filled with a gas such as air. The piston is fastened to one end portion of a rod, the other end portion of which protrudes from the cylinder to divide the inside of the cylinder into two gas chambers. A check valve is provided inside the piston and a sealing member such as oil seal is attached around an outer circumferential portion of the piston. In addition, to an inner circumference of the cylinder, a cylinder groove protruding from an inner circumferential surface toward an outer circumferential surface side is formed along an axial direction.

In this gas cylinder apparatus, in a compressing process, since a gas in the gas chamber compressed by the piston flows into the other gas chamber through the check valve provided to the piston and the cylinder groove formed to the cylinder, a damping force is rarely generated and the compressing process is promptly performed. On the other hand, in an expanding process, since the check valve is brought into a closed state, the gas in the other gas chamber flows into the gas chamber through the cylinder groove formed to the cylinder. An expansion side damping force is generated by a flow resistance at this time, and thereby the speed in the direction of rod extension is controlled.

Various kinds of devices for forming a cylinder groove to a cylinder of such gas cylinder apparatus have been proposed. For example, a cylinder groove processing device disclosed in Japanese Patent Application Laid-Open Publication No. 09-229123 is configured as follows. The cylinder groove processing device includes: a slide member able to be accommodated in a cylinder, in which a processing roller is rotatably provided in a protruding state and a guide roller is provided coaxially with the processing roller; and a guide member able to be accommodated in the cylinder, in which a main guide surface and first to fourth sub-guide surfaces are continuously provided, wherein the sub-guide surfaces guide the guide roller of the slide member so that the processing roller is brought into a state of non-contact with an inner surface of the cylinder, while the main guide surface guides the guide roller of the slide member so that the processing roller is brought into contact with the inner surface of the cylinder to thereby allow the cylinder to swell outward, and a cylinder groove is formed by the processing roller with relative movement of the slide member with respect to the cylinder and the guide member.

Due to formation of a cylinder groove to an inner circumferential surface of a cylinder, there occurs a possibility that, if a portion inwardly protruding from the inner circumferential surface of the cylinder is formed, after the cylinder is assembled to a gas cylinder apparatus, the portion may cause damage to a sealing member attached around an outer circumferential part of a piston when the piston slides.

An object of the present invention is to provide a device that forms a cylinder groove without forming a portion inwardly protruding from an inner circumferential surface of a cylinder.

SUMMARY

According to an aspect of the present invention, there is provided a groove processing device for processing a cylinder groove to an inner circumference of a cylinder, the cylinder groove protruding from an inner circumferential surface toward an outer circumferential surface side and extending in a direction of a center line of the cylinder, the device including: a first groove processing unit that moves in the direction of the center line while contacting the inner circumference of the cylinder to process both end portions of the cylinder groove in a circumferential direction thereof, and a second groove processing unit that processes a center portion of the cylinder groove in the circumferential direction thereof, wherein an outermost circumferential portion of each of the first groove processing unit and the second groove processing unit us formed to be a chevron shape so that a center portion thereof in the circumferential direction of the cylinder protrudes, and an inclination angle from a vertex portion in the outermost circumferential portion of the first groove processing unit is larger than an inclination angle from a vertex portion in the outermost circumferential portion of the second groove processing unit.

Here, the groove processing device may further have a first member that includes the first groove processing unit and a second member that is arranged along with the first member in the direction of the center line and includes the second groove processing unit, wherein the first member may contact the inner circumference of the cylinder to cause the inner circumference of the cylinder to protrude toward the outer circumferential surface side by the first groove processing unit, and thereafter, the second member may contact a portion caused to protrude by the first groove processing unit to cause the portion to further protrude toward the outer circumferential surface side by the second groove processing unit.

Or, the groove processing device according may further have a groove processing member that includes the first groove processing unit and the second groove processing unit, wherein the groove processing member may contact the inner circumference of the cylinder to process the cylinder groove by the first groove processing unit and the second groove processing unit.

According to another aspect of the present invention, there is provided a groove processing method for processing a cylinder groove to an inner circumference of a cylinder, the cylinder groove protruding from an inner circumferential surface toward an outer circumferential surface side and extending in a direction of a center line of the cylinder, the method including: moving a first groove processing unit in the direction of the center line while causing the first groove processing unit to contact the inner circumference of the cylinder, the first groove processing unit being formed to be a chevron shape so that a center portion thereof in the circumferential direction of the cylinder protrudes; and moving a second groove processing unit in the direction of the center line while causing the second groove processing unit to contact a center portion of a portion caused to protrude by the first groove processing unit, the second groove processing unit being formed to be a chevron shape so that a center portion thereof in the circumferential direction of the cylinder protrudes, and an inclination angle thereof from a vertex portion is smaller than an inclination angle from a vertex portion in the first groove processing unit.

According to still another aspect of the present invention, there is provided a groove processing method for processing a cylinder groove to an inner circumference of a cylinder, the cylinder groove protruding from an inner circumferential surface toward an outer circumferential surface side and extending in a direction of a center line of the cylinder, the method including: moving a groove processing member in the direction of the center line while causing the groove processing member to contact the inner circumference of the cylinder, the groove processing member including two groove processing units, each of which is formed to be a chevron shape so that a center portion thereof in the circumferential direction of the cylinder protrudes, and an inclination angle from a vertex portion in one of the groove processing units is smaller than an inclination angle from a vertex portion in the other one of the groove processing units.

According to the present invention, it is possible to form a cylinder groove without forming a portion inwardly protruding from an inner circumferential surface of a cylinder.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail with reference to the attached drawings.

Figure 1:
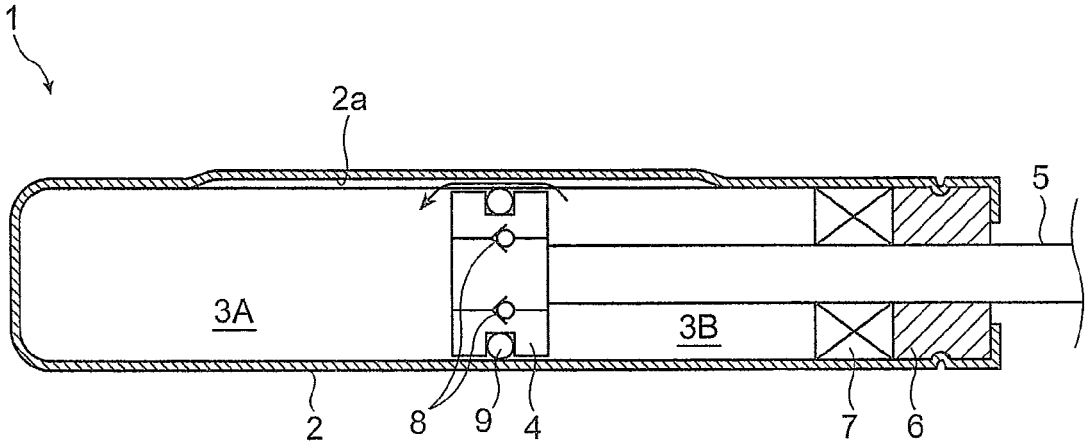
FIG. 1 is a diagram showing a schematic configuration of a gas cylinder apparatus according to exemplary embodiments.

FIG. 1 is a diagram showing a schematic configuration of a gas cylinder apparatus 1 according to the exemplary embodiments.

The gas cylinder apparatus 1 is attached between a door and a body of a vehicle for reducing a force required by a user to open the door of the vehicle.

The gas cylinder apparatus 1 includes a cylinder 2 that is filled with a gas such as air, and a piston 4 that slides within the cylinder 2. The cylinder 2 is a thin-walled cylindrical member, in which one end in a center line direction of the cylindrical member (hereinafter, simply referred to as "center line direction" in some cases) is closed, while the other end thereof is opened. In this cylinder 2, a cylinder groove 2*a* protruding from an inner circumferential surface toward an outer circumferential surface side while extending in the center line direction is formed.

The gas cylinder apparatus 1 also includes: a rod 5 in which the piston 4 is attached to one end portion in the centerline direction thereof, and the other end portion protrudes to the outside of the cylinder 2; a rod guide 6 that is arranged at the other end in the cylinder 2 and guides movement of the rod 5 in the center line direction; and a gas seal 7 that is also arranged on the other end portion side of the cylinder 2 to be closer to the one end portion side than the rod guide 6.

In the piston 4, check valves 8 are provided inside thereof, and a sealing member 9 such as an O-ring is attached around an outer circumferential portion thereof. The piston 4, the sealing member 9 and the like divide the inside of the cylinder 2 into two gas chambers. In other words, the inside of the cylinder 2 is divided into one gas chamber 3A that is surrounded by the piston 4, the sealing member 9 and the one end portion in the center line direction of the cylinder 2, and the other gas chamber 3B that is surrounded by the piston 4, the sealing member 9, the cylinder 2 and the gas seal 7.

In the gas cylinder apparatus 1, in the compressing process, since the gas in the one gas chamber 3A flows into the other gas chamber 3B through the check valves 8 provided in the piston 4 and the cylinder groove 2*a* formed to the cylinder 2, the damping force is rarely generated, and thereby the compressing process is promptly performed. On the other hand, in the expanding process, since the check valves 8 are brought into a closed state, the gas in the other gas chamber 3B flows into the one gas chamber 3A through the cylinder groove 2*a* formed to the cylinder 2. An expansion side damping force is generated by the flow resistance at this time, to thereby control the speed of the rod 5 in the extending direction.

Next, a description will be given to the groove forming device 100 that forms the cylinder groove 2*a* to the cylinder 2.

First Exemplary Embodiment

Figure 2:
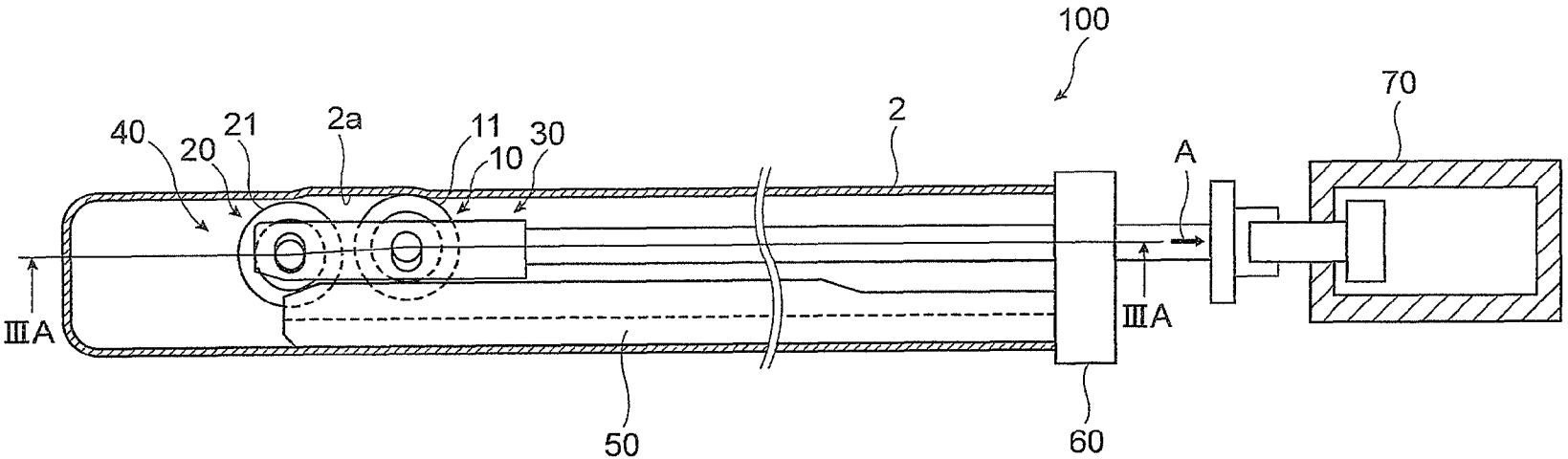
FIG. 2 is a diagram showing a schematic configuration of a groove forming device according to a first exemplary embodiment.

FIG. 2 is a diagram showing a schematic configuration of the groove forming device 100 according to the first exemplary embodiment.

The groove forming device 100 includes: a rod-shaped slide unit 40 that is able to be accommodated in the cylinder 2 and movable in the center line direction; a rod-shaped guide unit 50 that is able to be accommodated in the cylinder 2 and guides the movement of the slide unit 40 in the center line direction; a support member 60 that supports the cylinder 2; and a slide moving device 70 that moves the slide unit 40 in the center line direction.

Figure 3A:
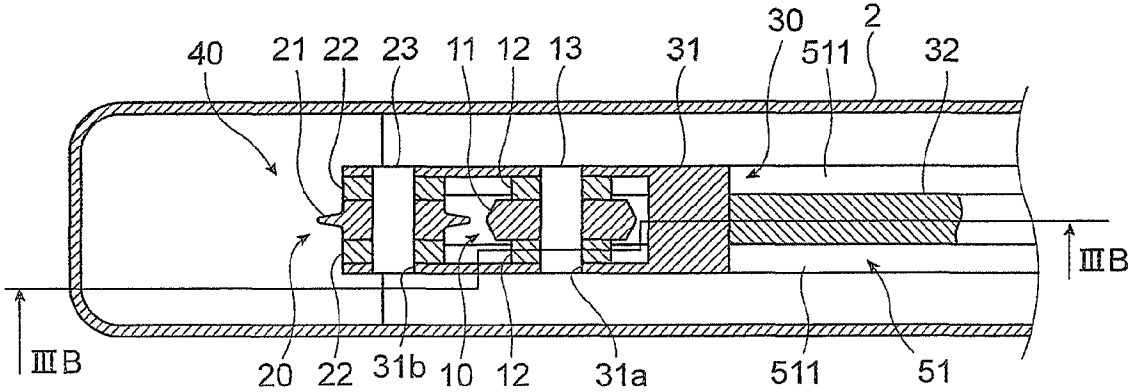
FIG. 3A is a cross-sectional view taken along the IIIA-IIIA part in FIG. 2.
Figure 3B:
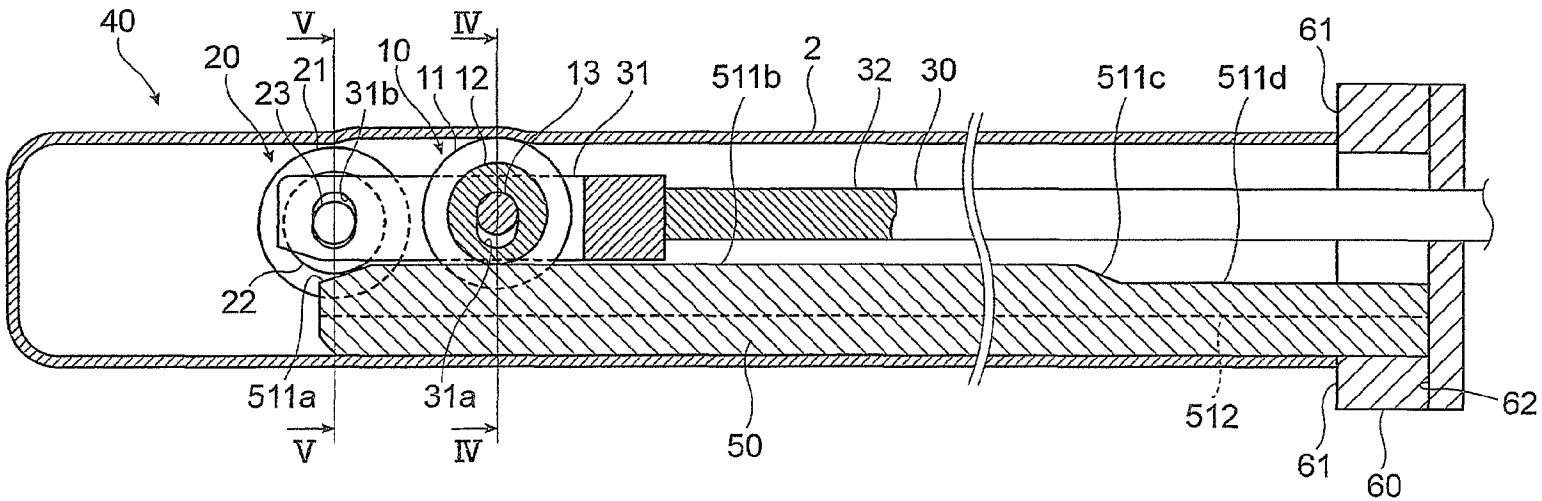
FIG. 3B is a cross-sectional view taken along the IIIB-IIIB part in FIG. 3A.

FIG. 3A is a cross-sectional view taken along the IIIA-IIIA part in FIG. 2. FIG. 3B is a cross-sectional view taken along the IIIB-IIIB part in FIG. 3A.

The slide unit 40 includes: a first processing unit 10 as an example of a first member that forms both end portions in the circumferential direction of the cylinder groove 2*a* of the cylinder 2; a second processing unit 20 as an example of a second member that forms a center portion in the circumferential direction of the cylinder groove 2*a*; and a rod-shaped support member 30 provided with a support unit 31 for supporting the first processing unit 10 and the second processing unit 20 at a tip end portion side thereof. The first processing unit 10 and the second processing unit 20 are arranged along with each other in the center line direction.

Figure 4:
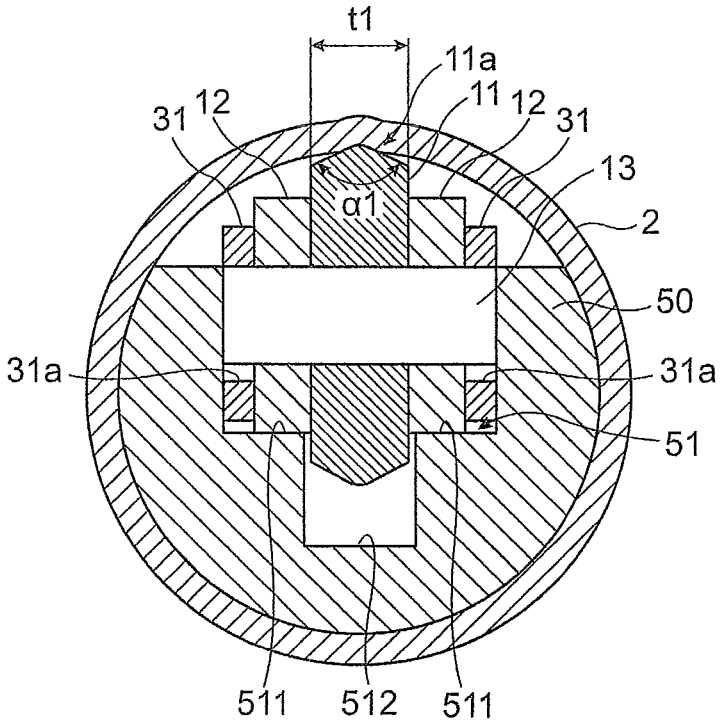
FIG. 4 is a cross-sectional view taken along the IV-IV part in FIG. 3B.

FIG. 4 is a cross-sectional view taken along the IV-IV part in FIG. 3B.

The first processing unit 10 includes: a disc-shaped first processing roller 11 as an example of a first groove processing unit that deforms a part of the cylinder 2 in the circumferential direction thereof so as to protrude from an inner circumferential surface side toward an outer circumferential surface side of the cylinder 2 by contacting the inner circumferential surface of the cylinder 2; and a pair of cylindrical first guide rollers 12 arranged on respective both end surfaces of the first processing roller 11. The first processing roller 11 and the pair of first guide rollers 12 are arranged coaxially, and rotate around a first shaft 13 supported by the support unit 31 of the support member 30 as a rotational shaft.

Figure 5:
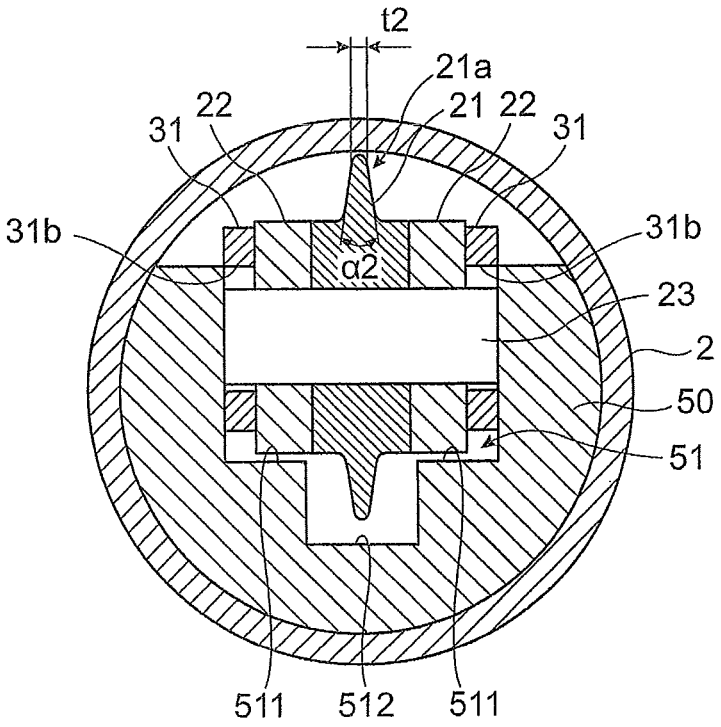
FIG. 5 is a cross-sectional view taken along the V-V part in FIG. 3B.

FIG. 5 is a cross-sectional view taken along the V-V part in FIG. 3B.

The second processing unit 20 includes: a disc-shaped second processing roller 21 as an example of a second groove processing unit that deforms a part of the cylinder 2 in the circumferential direction thereof so as to protrude from the inner circumferential surface side toward the outer circumferential surface side of the cylinder 2 by contacting the inner circumferential surface of the cylinder 2; and a pair of cylindrical second guide rollers 22 arranged on respective both end surfaces of the second processing roller 21. The second processing roller 21 and the pair of second guide rollers 22 are arranged coaxially, and rotate around a second shaft 23 supported by the support unit 31 of the support member 30 as a rotational shaft.

An outermost circumferential portion 11*a* of the first processing roller 11 has a chevron shape with an obtuse angle, while an outermost circumferential portion 21*a* of the second processing roller 21 has a chevron shape with an acute angle. In other words, an angle $\alpha$1 of the outermost circumferential portion 11*a* of the first processing roller 11 is larger than an angle $\alpha$2 of the outermost circumferential portion 21*a* of the second processing roller 21. That is, an inclination angle from a vertex portion of the outermost circumferential portion 11*a* of the first processing roller 11 is larger than an inclination angle from a vertex portion of the outermost circumferential portion 21*a* of the second processing roller 21. Moreover, a width t1 of the outermost circumferential portion 11*a* of the first processing roller 11 is wider than a width t2 of the outermost circumferential portion 21*a* of the second processing roller 21, and the first processing roller 11 and the second processing roller 21 are attached so that a center in the width direction of the outermost circumferential portion 11*a* and a center in the width direction of the outermost circumferential portion 21*a* are on the same position.

The support member 30 is provided with the support unit 31 for supporting the first processing unit 10 and second processing unit 20 on one end portion (tip end portion) side thereof, and is also provided with a rod 32 on the other end portion side than the support unit 31. The support unit 31 is formed in a U-shape as viewed from above (refer to FIG. 3A), to accommodate the first processing unit 10 and the second processing unit 20 inside thereof. In the support unit 31, a support hole 31*a* that supports respective both end portions of the first shaft 13 and a support hole 31*b* that supports respective both end portions of the second shaft 23 are formed. Each of the support hole 31*a* and the support hole 31*b* is formed to be a long hole so that the first shaft 13 and the second shaft 23 are movable in the center line direction and a direction orthogonal to a shaft center of the first shaft 13.

An outer surface (lower surface in FIG. 2) of a part of the guide unit 50 is formed to be a circumferential surface along the inner circumferential surface of the cylinder 2. Moreover, in the guide unit 50, a processing-unit accommodation unit 51 capable of accommodating the first processing unit 10 and the second processing unit 20 of the slide unit 40 is provided over an entire region in the center line direction. As shown in FIGS. 4 and 5, the processing-unit accommodation unit 51 has two support planes 511 that rollably support each of the pair of first guide rollers 12 of the first processing unit 10 and the pair of second guide rollers 22 of the second processing unit 20, and a recessed portion 512 for containing the first guide rollers 12 and the second guide rollers 22 is provided between the two support planes 511.

As viewed in FIG. 3B, from one end portion side to the other end portion side of the cylinder 2, the support plane 511 is configured with an upward-inclined plane 511*a* that rises from one end portion side to the other end portion side of the cylinder 2, a main horizontal plane 511*b* that is a horizontal plane, a downward-inclined plane 511*c* that descends from one end portion side to the other end portion side, and a sub-horizontal plane 511*d* that is a horizontal plane.

The upward-inclined plane 511*a* guides the pair of first guide rollers 12 of the first processing unit 10 in a rolling state in the direction of arrow A in FIG. 2, and at this time, gradually brings the outermost circumferential portion 11*a* opposite to the guide unit 50 in the first processing roller 11 of the first processing unit 10 from a state not to contact the inner circumferential surface of the cylinder 2 (hereinafter, referred to as "non-contact state") into a state to contact the inner circumferential surface of the cylinder 2 (hereinafter, referred to as "contact state"). Similarly, the upward-inclined plane 511*a* guides the pair of second guide rollers 22 of the second processing unit 20 in a rolling state in the direction of arrow A in FIG. 2, and at this time, gradually brings the outermost circumferential portion 21*a* opposite to the guide unit 50 in the second processing roller 21 of the second processing unit 20 from the non-contact state with the inner circumferential surface of the cylinder 2 into the contact state.

The main horizontal plane 511*b* guides the pair of first guide rollers 12 of the first processing unit 10 in a rolling state in the direction of arrow A in FIG. 2, and at this time, brings the outermost circumferential portion 11*a* opposite to the guide unit 50 in the first processing roller 11 of the first processing unit 10 into the contact state with the inner circumferential surface of the cylinder 2. Similarly, the main horizontal plane 511*b* guides the pair of second guide rollers 22 of the second processing unit 20 in a rolling state in the direction of arrow A in FIG. 2, and at this time, brings the outermost circumferential portion 21*a* opposite to the guide unit 50 in the second processing roller 21 of the second processing unit 20 into the contact state with the inner circumferential surface of the cylinder 2.

The downward-inclined plane 511*c* guides the pair of first guide rollers 12 of the first processing unit 10 in a rolling state in the direction of arrow A in FIG. 2, and at this time, gradually brings the outermost circumferential portion 11*a* opposite to the guide unit 50 in the first processing roller 11 of the first processing unit 10 from the contact state to the non-contact state with the inner circumferential surface of the cylinder 2. Similarly, the downward-inclined plane 511*c* guides the pair of second guide rollers 22 of the second processing unit 20 in a rolling state in the direction of arrow A in FIG. 2, and at this time, gradually brings the outermost circumferential portion 21*a* opposite to the guide unit 50 in the second processing roller 21 of the second processing unit 20 from the contact state with the inner circumferential surface of the cylinder 2 into the non-contact state.

The sub-horizontal plane 511*d* guides the pair of first guide rollers 12 of the first processing unit 10 in a rolling state in the direction of arrow A in FIG. 2, and at this time, brings the outermost circumferential portion 11*a* opposite to the guide unit 50 in the first processing roller 11 of the first processing unit 10 into the non-contact state with the inner circumferential surface of the cylinder 2. Similarly, the sub-horizontal plane 511*d* guides the pair of second guide rollers 22 of the second processing unit 20 in a rolling state in the direction of arrow A in FIG. 2, and at this time, brings the outermost circumferential portion 21*a* opposite to the guide unit 50 in the second processing roller 21 of the second processing unit 29 into the non-contact state with the inner circumferential surface of the cylinder 2.

The support member 60 includes a cylinder suppressing unit 61 that suppresses movement of the cylinder 2 and a guide-portion suppressing unit 62 that suppresses movement of the guide unit 50 while the cylinder groove 2*a* is formed.

The slide moving device 70 is configured with a well-known fluid pressure cylinder device that is connected to a base end portion of the rod 32 in the support member 30.

Next, operation of the groove forming device 100 according to the first exemplary embodiment as configured above will be described.

FIGS. 6A to 6F are diagrams showing a state where the groove forming device 100 (refer to FIG. 2) according to the first exemplary embodiment forms the cylinder groove 2*a* to the cylinder 2.

The first processing unit 10 and the second processing unit 20 are attached to the support member 30 of the slide unit 40. With a state where the first processing unit 10 is accommodated in the processing-unit accommodation unit 51 (refer to FIGS. 3A and 3B and FIG. 4) of the guide unit 50 to bring the pair of first guide rollers 12 of the first processing unit 10 into contact with the upward-inclined plane 511*a*, the slide unit 40 and the guide unit 50 are inserted into the cylinder 2, to which the cylinder groove 2*a* has not been processed (refer to FIG. 6A). At this time, the outermost circumferential portion 11*a* opposite to the guide unit 50 in the first processing roller 11 of the first processing unit 10 and the outermost circumferential portion 21*a* opposite to the guide unit 50 in the second processing roller 21 of the second processing unit 20 are in non-contact state with the inner circumferential surface of the cylinder 2.

Next, in the slide moving device 70, the slide unit 40 is relatively moved with respect to the guide unit 50 and the cylinder 2 in the direction of arrow A in FIG. 2 in the center line direction. This causes the pair of first guide rollers 12 of the first processing unit 10 to roll along the upward-inclined plane 511*a* and the outermost circumferential portion 11*a* opposite to the guide unit 50 in the first processing roller 11 to be gradually brought into the contact state with the inner circumferential surface of the cylinder 2 from the non-contact state.

Further, in the slide moving device 70, the slide unit 40 is relatively moved with respect to the guide unit 50 and the cylinder 2 in the direction of arrow A in FIG. 2 in the center line direction and the pair of first guide rollers 12 of the first processing unit 10 are relatively rolled along the main horizontal plane 511*b*. This causes the outermost circumferential portion 11*a* opposite to the guide unit 50 in the first processing roller 11 to move in the center line direction in the state of contacting a part of the cylinder 2 in the circumferential direction thereof to deform the part of the cylinder 2 in the circumferential direction to protrude from the inner circumferential surface side toward the outer circumferential surface side along the center line direction (refer to FIGS. 6B and 6C).

Figure 6A:
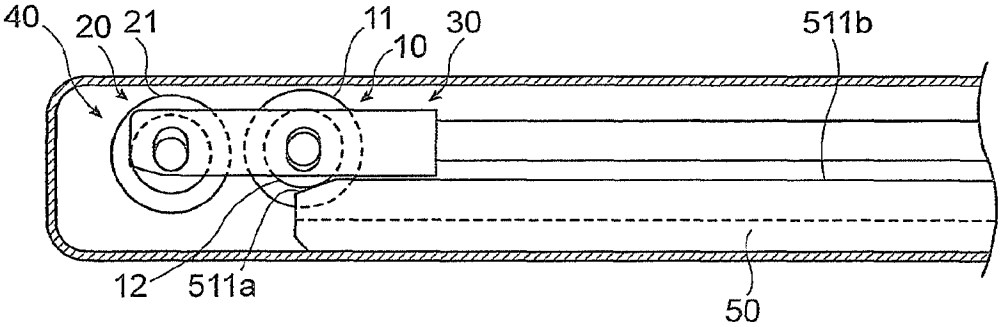
FIGS. 6A to 6F are diagrams showing a state where the groove forming device according to the first exemplary embodiment forms a cylinder groove to a cylinder.
Figure 6B:
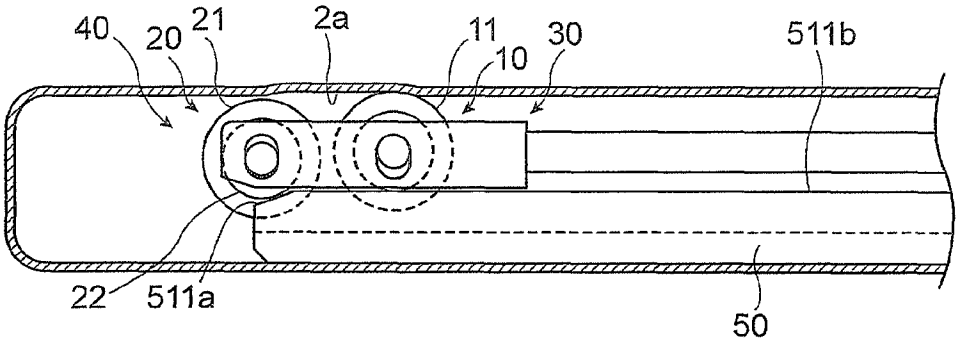
Figure 6C:
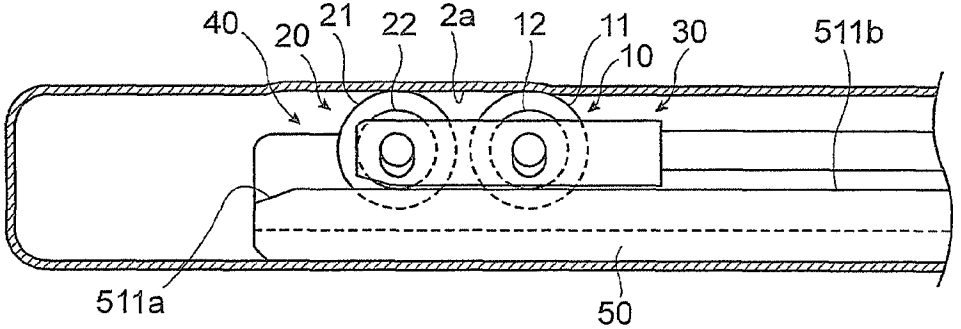
Figure 6D:
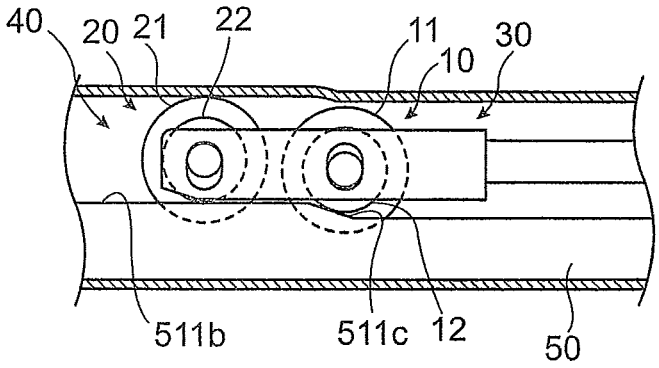

As the slide moving device 70 moves the slide unit 40 in the center line direction, the pair of second guide rollers 22 of the second processing unit 20 are brought into contact with the upward-inclined plane 511*a* and roll along the upward-inclined plane 511*a* (refer to FIG. 6B). This gradually brings the outermost circumferential portion 21*a* opposite to the guide unit 50 in the second processing roller 21 into the contact state with a part of the portion of the inner circumference of the cylinder 2 having been deformed by the first processing roller 11 from the non-contact state. Then, as the slide moving device 70 further moves the slide unit 40 in the center line direction, the pair of second guide rollers 22 of the second processing unit 20 relatively roll and move along the main horizontal plane 511*b*. Consequently, the outermost circumferential portion 21*a* opposite to the guide unit 50 in the second processing roller 21 further deforms the part of the portion having been deformed by the first processing roller 11 so as to protrude from the inner circumferential surface side toward the outer circumferential surface side along the center line direction (refer to FIG. 6C).

When the slide moving device 70 further moves the slide unit 40 in the center line direction from the state where both first guide rollers 12 and second guide rollers 22 relatively move along the main horizontal surface 511*b*, the first guide rollers 12 roll along the downward-inclined plane 511*c*. This gradually brings the outermost circumferential portion 11*a* opposite to the guide unit 50 in the first processing roller 11 into the non-contact state from the contact state with the inner circumferential surface of the cylinder 2 (refer to FIG. 6D).

Figure 6E:
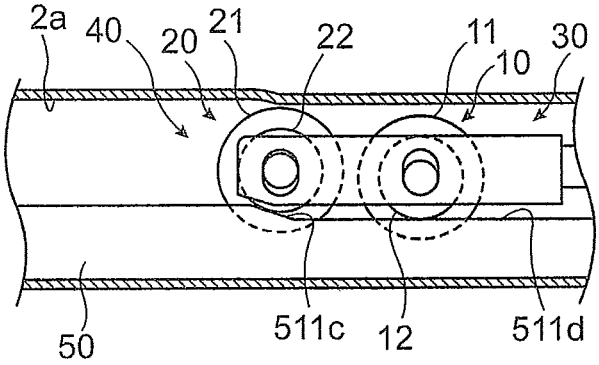

Further, the slide moving device 70 moves the slide unit 40 in the center line direction and rolls the first guide rollers 12 along the sub-horizontal plane 511*d* (refer to FIG. 6E). With that, the second guide rollers 22 roll along the downward-inclined plane 511*c* (also refer to FIG. 6E). This gradually brings the outermost circumferential portion 21*a* opposite to the guide unit 50 in the second processing roller 21 into the non-contact state from the contact state with the portion in the inner circumferential of the cylinder 2 having been deformed by the first processing roller 11.

Figure 6F:
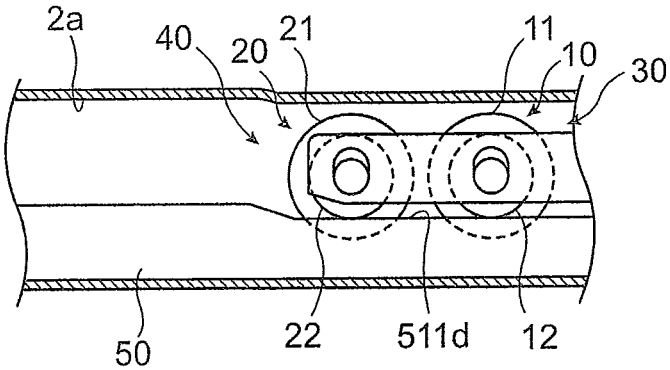

Finally, the slide moving device 70 rolls both first guide rollers 12 and the second guide rollers 22 along the sub-horizontal plane 511*d*, pulls the first processing unit 10 and the second processing unit 20 out of the cylinder 2, to thereby finish the processing operation of the cylinder groove 2*a* (refer to FIG. 6F).

Accordingly, the cylinder groove 2*a* is formed to the cylinder 2.

Figure 7:
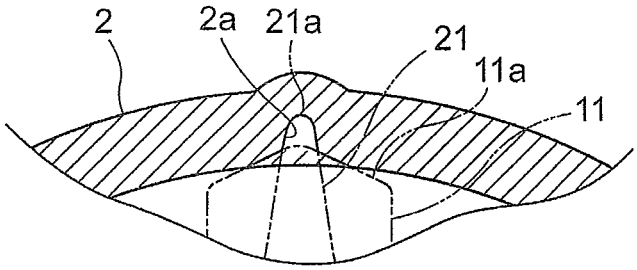
FIG. 7 is an enlarged view of the cylinder groove formed to the cylinder.

FIG. 7 is an enlarged view of the cylinder groove 2*a* formed to the cylinder 2.

As described above, the outermost circumferential portion 11*a* in the first processing roller 11 has a chevron shape with an obtuse angle, while an outermost circumferential portion 21*a* in the second processing roller 21 has a chevron shape with an acute angle. Moreover, the width t1 of the outermost circumferential portion 11*a* in the first processing roller 11 is wider than the width t2 of the outermost circumferential portion 21*a* in the second processing roller 21, and the first processing roller 11 and the second processing roller 21 are attached so that a center in the width direction of the outermost circumferential portion 11*a* and a center in the width direction of the outermost circumferential portion 21*a* are on the same position. Accordingly, the first processing roller 11 forms both end portions of the cylinder groove 2*a* in the circumferential direction, and the second processing roller 21 forms the center portion of the cylinder groove 2*a* in the circumferential direction. Therefore, even though a portion that protrudes toward the center of the cylinder 2 is formed due to deformation of the inner circumference of the cylinder 2 so as to protrude from the inner circumferential surface side toward the outer circumferential surface side by the second processing roller 21 having a small width and acute angle, the portion hardly protrudes from the inner circumferential surface of the cylinder toward the center thereof.

Moreover, the inner circumference of the cylinder 2 is deformed by the first processing roller 11, and thereafter, the center part of the portion having been deformed by the first processing roller 11 is deformed so as to protrude from the inner circumferential surface side toward the outer circumferential surface side by the second processing roller 21. The first processing roller 11 and the second processing roller 21 are attached so that the center in the width direction of the outermost circumferential portion 11*a* of the first processing roller 11 and the center in the width direction of the outermost circumferential portion 21*a* of the second processing roller 21 become the same. Accordingly, the second processing roller 21 easily deform the center part of the portion having been deformed by the first processing roller 11, and the part formed by the second processing roller 21 tends to have the same shape in the center line direction with more accuracy.

Consequently, with the gas cylinder apparatus 1 using the cylinder 2 to which the cylinder groove 2*a* is formed by the groove forming device 100 according to the first exemplary embodiment, even though the piston 4 slides in the center line direction, a possibility that the sealing member 9 attached around the outer circumferential portion of the piston 4 is damaged is suppressed.

It should be noted that, in the above-described exemplary embodiment, as an example of the shape of each of the outermost circumferential portion 11*a* in the first processing roller 11 and the outermost circumferential portion 21*a* in the second processing roller 21, the shape having an inclined plane from the vertex portion is provided; however, the shape is not particularly limited thereto. For example, the outermost circumferential portion 11*a* in the first processing roller 11 or the outermost circumferential portion 21*a* in the second processing roller 21 may have a shape in which the vertex portion and a hem portion are connected by a curved plane. In such a case, it is better if an angle ($\alpha$1) formed by planes connecting the vertex portion and the hem portion in the outermost circumferential portion 11*a* of the first processing roller 11 is larger than an angle ($\alpha$2) formed by planes connecting the vertex portion and the hem portion in the outermost circumferential portion 21*a* of the second processing roller 21.

Second Exemplary Embodiment

In the groove forming device 100 according to the second exemplary embodiment, the slide unit 40 is different from that of the groove forming device 100 according to the first exemplary embodiment. Hereinbelow, a description will be given only to the points that are different from the groove forming device 100 according to the first exemplary embodiment.

Figure 8:
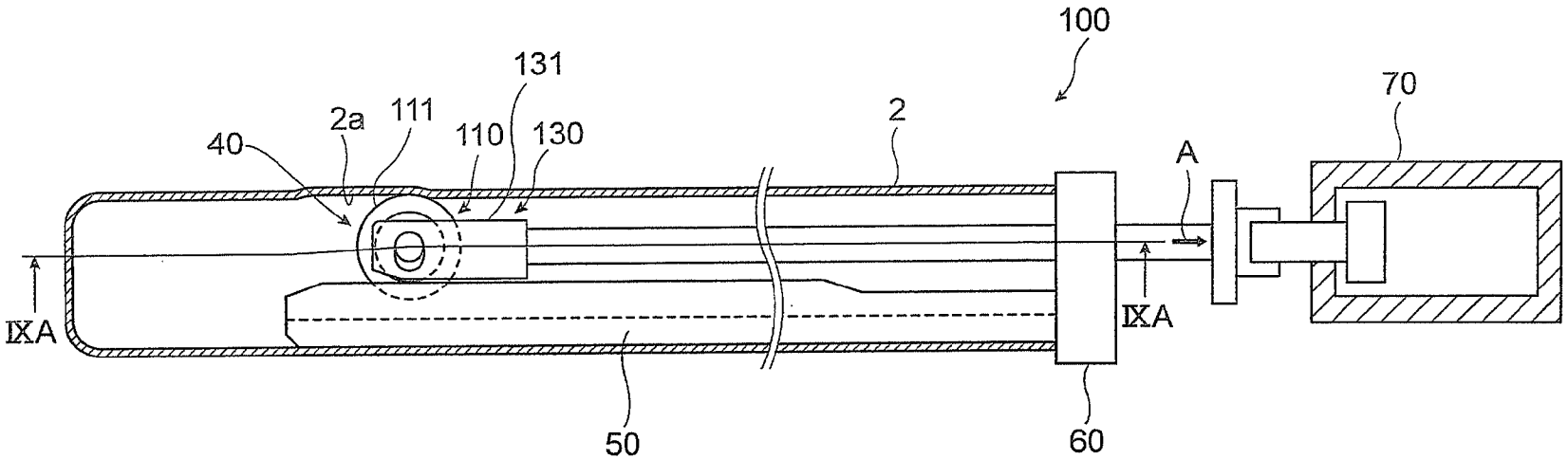
FIG. 8 is a diagram showing a schematic configuration of a groove forming device according to a second exemplary embodiment.

FIG. 8 is a diagram showing a schematic configuration of the groove forming device 100 according to a second exemplary embodiment.

Figure 9A:
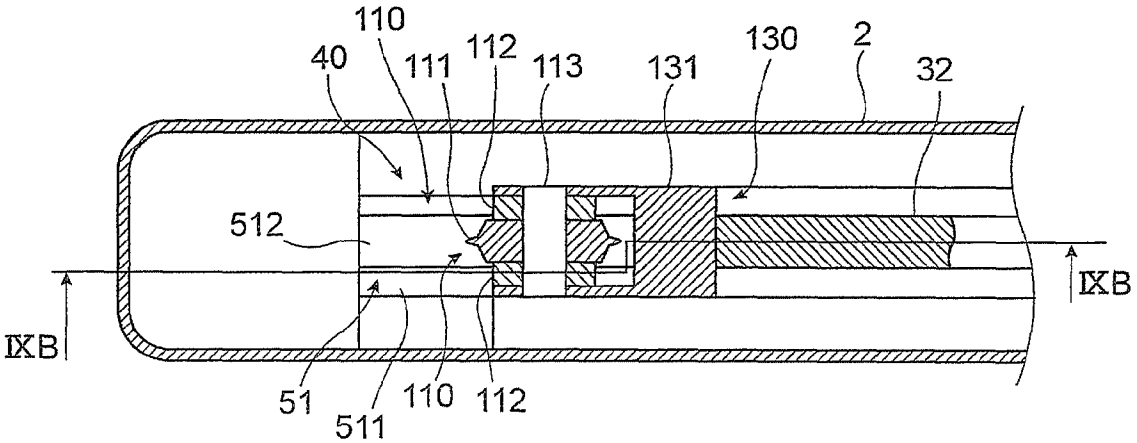
FIG. 9A is a cross-sectional view taken along the IXA-IXA part in FIG. 8.
Figure 9B:
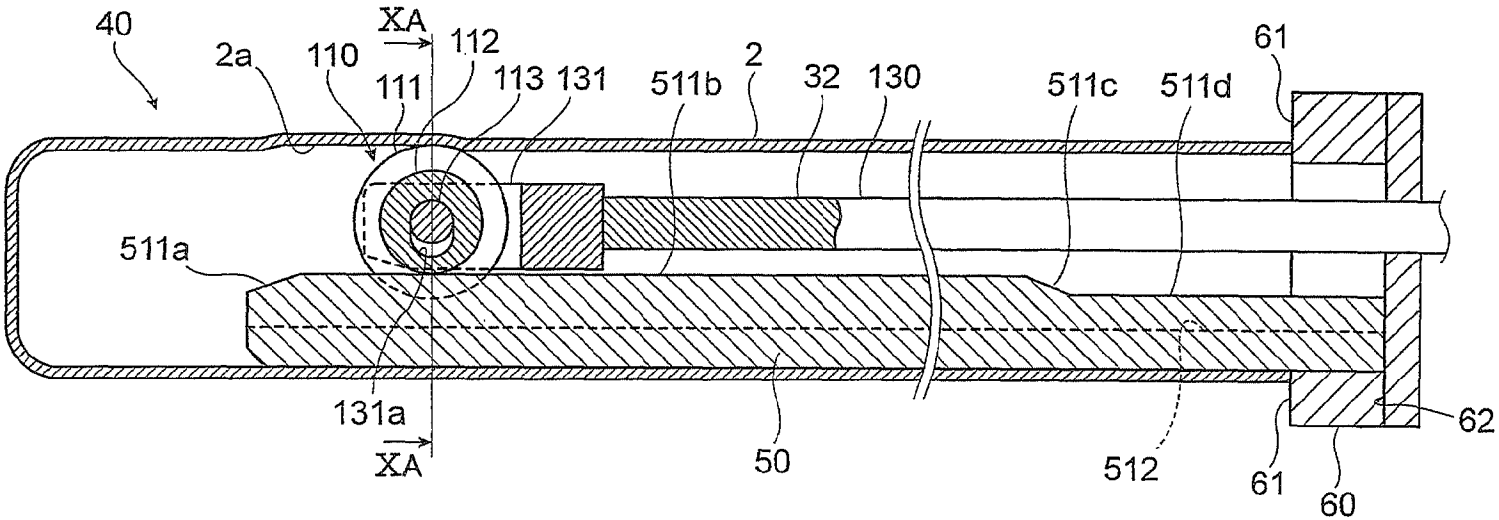
FIG. 9B is a cross-sectional view taken along the IXB-IXB part in FIG. 9A.

FIG. 9A is a cross-sectional view taken along the IXA-IXA part in FIG. 8. FIG. 9B is a cross-sectional view taken along the IXB-IXB part in FIG. 9A.

The slide unit 40 according to the second exemplary embodiment includes a processing unit 110 that forms the cylinder groove 2*a* to the cylinder 2, and a rod-shaped support member 130 provided with a support unit 131 that supports the processing unit 110 on a tip end portion side thereof. The support member 130 is the same as the support member 30 according to the first exemplary embodiment except for the shape of the support unit 131 only.

Figure 10A:
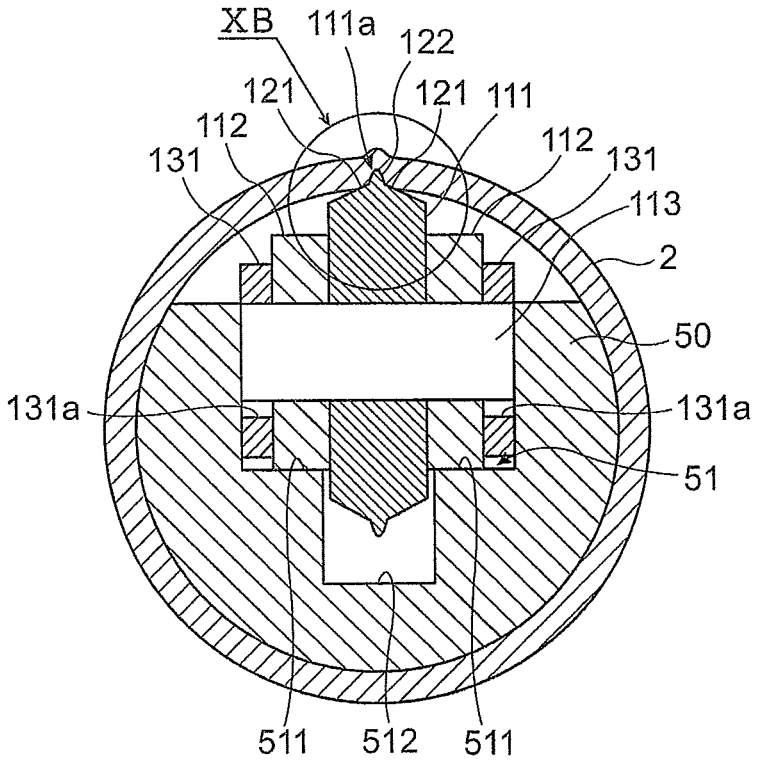
FIG. 10A is a cross-sectional view taken along the XA-XA part in FIG. 9B.
Figure 10B:
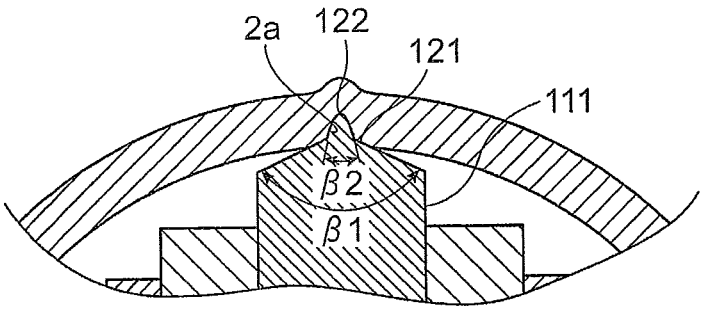
FIG. 10B is an enlarged view of the XB part in FIG. 10A.

FIG. 10A is a cross-sectional view taken along the XA-XA part in FIG. 9B. FIG. 10B is an enlarged view of the XB part in FIG. 10A.

The processing unit 110 includes a disc-shaped processing roller 111 as an example of a groove processing member that deforms a part of the cylinder 2 in the circumferential direction thereof so as to protrude from an inner circumferential surface side toward an outer circumferential surface side of the cylinder 2 by contacting the inner circumferential surface of the cylinder 2, and a pair of cylindrical guide rollers 112 arranged on respective both end surfaces of the processing roller 111. The processing roller 111 and the pair of guide rollers 112 are arranged coaxially, and rotate around a shaft 113 supported by the support unit 131 of the support member 130 as a rotational shaft.

An outermost circumferential portion 111*a* in the processing roller 111 has a first groove processing portion 121 that processes both end portions of the cylinder groove 2*a* in the circumferential direction, and a second groove processing portion 122 that forms a center portion of the cylinder groove 2*a* in the circumferential direction. The first groove processing portion 121 has an inclined surface in each of both end portions, the inclined surface being formed to face the outer circumference side as approaching the second groove processing portion 122, and an angle formed by the inclined surfaces mutually is an obtuse angle. The second groove processing portion 122 has a chevron shape with an acute angle. In other words, the angle $\beta$1 formed by both inclined surfaces of the first groove processing portion 121 is larger than the angle $\beta$2 of the second groove processing portion 122.

The support member 130 is provided with the support unit 131 for supporting the processing unit 110 on one end portion (tip end portion) side thereof, and is also provided with a rod 32 on the other end portion side than the support unit 131. The support unit 131 is formed in a U-shape as viewed from above (refer to FIG. 9A), to accommodate the processing unit 110 inside thereof. In the support unit 131, a support hole 131*a* that supports respective both end portions of the shaft 113 is formed. The support hole 131*a* is formed to be a long hole so that the shaft 113 is movable in the center line direction and a direction orthogonal to a shaft center of the shaft 113.

Next, operation of the groove forming device 100 according to the second exemplary embodiment as configured above will be described.

FIGS. 11A to 11D are diagrams showing a state where the groove forming device 100 according to the second exemplary embodiment forms the cylinder groove 2*a* to the cylinder 2.

The processing unit 110 is attached to the support member 130 of the slide unit 40. With a state where the processing unit 110 is accommodated in the processing-unit accommodation unit 51 (refer to FIG. 10A) of the guide unit 50 to bring the pair of guide rollers 112 of the processing unit 110 into contact with the upward-inclined plane 511*a*, the slide unit 40 and the guide unit 50 are inserted into the cylinder 2, to which the cylinder groove 2*a* has not been processed (refer to FIG. 11A). At this time, the outermost circumferential portion 111*a* opposite to the guide unit 50 in the processing roller 111 of the processing unit 110 is in non-contact state with the inner circumferential surface of the cylinder 2.

Next, in the slide moving device 70, the slide unit 40 is relatively moved with respect to the guide unit 50 and the cylinder 2 in the direction of arrow A in FIG. 8 in the center line direction. This causes the pair of guide rollers 112 of the processing unit 110 to roll along the upward-inclined plane 511*a* and the outermost circumferential portion 111*a* opposite to the guide unit 50 in the processing roller 111 to be gradually brought into the contact state with the inner circumferential surface of the cylinder 2 from the non-contact state.

Further, in the slide moving device 70, the slide unit 40 is relatively moved with respect to the guide unit 50 and the cylinder 2 in the direction of arrow A in FIG. 8 in the center line direction and the pair of guide rollers 112 of the processing unit 110 are relatively rolled along the main horizontal plane 511*b*. This causes the outermost circumferential portion 111*a* opposite to the guide unit 50 in the processing roller 111 to move in the center line direction in the state of contacting a part of the cylinder 2 in the circumferential direction thereof to deform the part of the cylinder 2 in the circumferential direction to protrude from the inner circumferential surface side toward the outer circumferential surface side along the center line direction (refer to FIG. 11B).

Figure 11A:
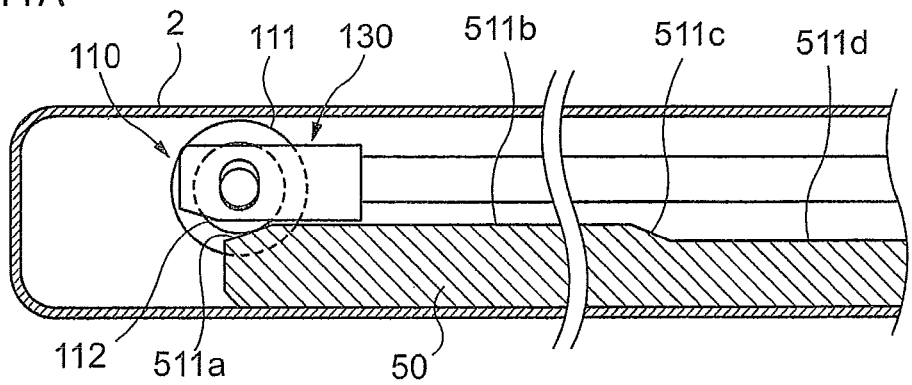
FIGS. 11A to 11D are diagrams showing a state where the groove forming device according to the second exemplary embodiment forms a cylinder groove to a cylinder.
Figure 11B:
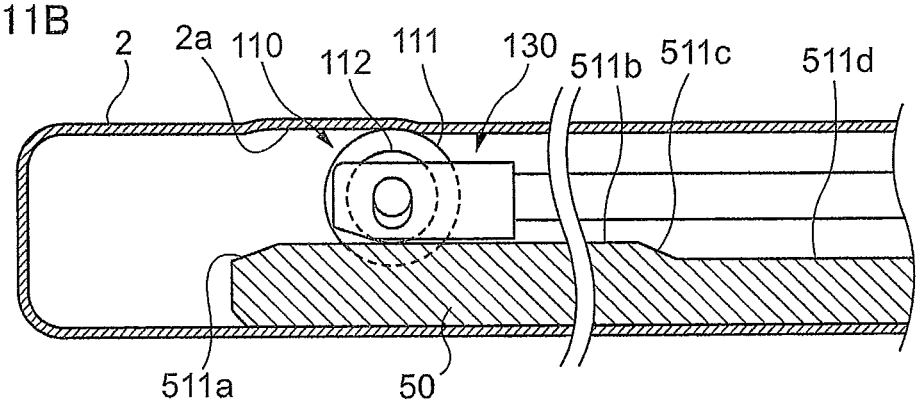
Figure 11C:
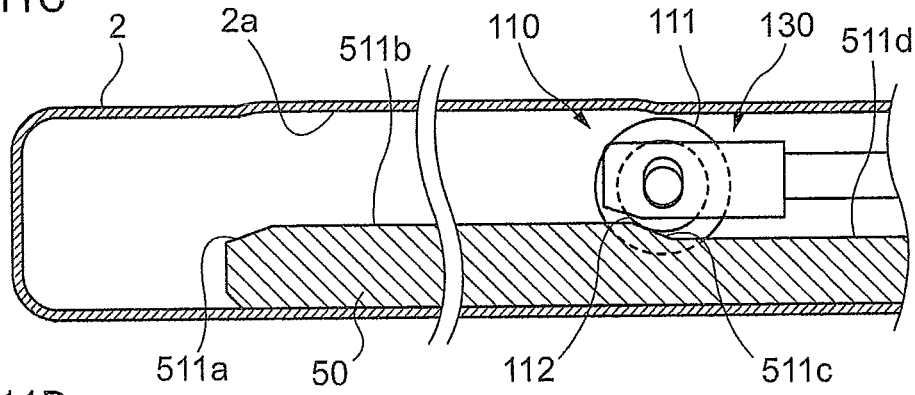
Figure 11D:
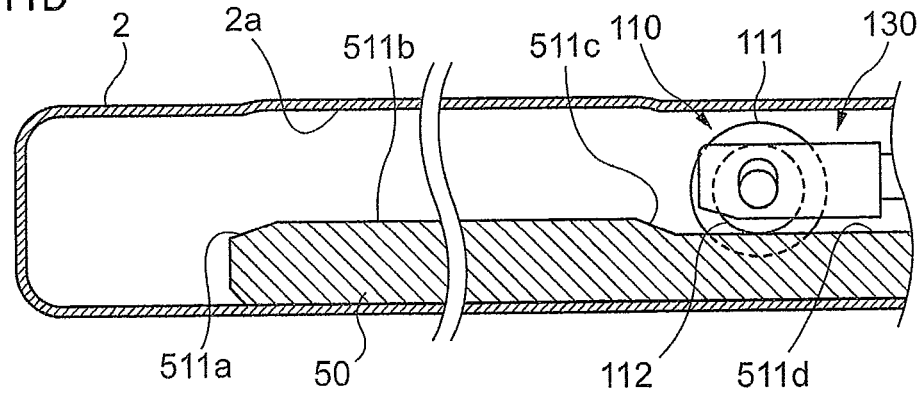

When the slide moving device 70 further moves the slide unit 40 in the center line direction from the state where guide rollers 112 relatively move along the main horizontal surface 511*b*, the guide rollers 112 roll along the downward-inclined plane 511*c* (refer to FIG. 11C). This gradually brings the outermost circumferential portion 111*a* opposite to the guide unit 50 in the processing roller 111 into the non-contact state from the contact state with the inner circumferential surface of the cylinder 2.

Finally, the slide moving device 70 rolls the guide rollers 112 along the sub-horizontal plane 511*d* (refer to FIG. 11D), pulls the processing unit 110 out of the cylinder 2, to thereby finish the processing operation of the cylinder groove 2*a*.

Accordingly, the cylinder groove 2*a* having a shape similar to that shown in FIG. 7 is formed in the cylinder 2. That is, both end portions of the cylinder groove 2*a* in the circumferential direction are formed by the first groove processing portion 121 in the processing roller 111, in which an angle formed by the inclined surfaces provided in both end portions thereof mutually is an obtuse angle, and the center portion of the cylinder groove 2*a* in the circumferential direction is formed by the second groove processing portion 122 having a chevron shape of an acute angle. Therefore, even though a portion that protrudes toward the center of the cylinder 2 is formed due to deformation of the inner circumference of the cylinder 2 so as to protrude from the inner circumferential surface side toward the outer circumferential surface side by the second groove processing portion 122 having a small width and acute angle, the portion hardly protrudes from the inner circumferential surface of the cylinder toward the center thereof.

Moreover, since the first groove processing portion 121 and the second groove processing portion 122 are provided to the processing roller 111, which is a single member, the cylinder groove 2*a* tends to have the same shape over the entire region in the center line direction and have a symmetrical shape in the circumferential direction.

Consequently, with the gas cylinder apparatus 1 using the cylinder 2 to which the cylinder groove 2*a* is formed by the groove forming device 100 according to the second exemplary embodiment, even though the piston 4 slides in the center line direction, a possibility that the sealing member 9 attached around the outer circumferential portion of the piston 4 is damaged is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A groove processing device for processing a cylinder groove to an inner circumference of a cylinder, the cylinder groove protruding from an inner circumferential surface toward an outer circumferential surface side and extending in a direction of a center line of the cylinder, the device comprising:

a groove processing member that moves in the direction of the center line while contacting the inner circumference of the cylinder, the groove processing member including a first groove processing portion and a second groove processing portion in a single body, the first groove processing portion processing both end portions of the cylinder groove in a circumferential direction thereof, and the second groove processing portion processing a center portion of the cylinder groove in the circumferential direction thereof, wherein an outermost circumferential portion of each of the first groove processing portion and the second groove processing portion is formed to be a chevron shape so that a center portion thereof in the circumferential direction of the cylinder protrudes, and an inclination angle from a vertex portion in the outermost circumferential portion of the first groove processing portion is larger than an inclination angle from a vertex portion in the outermost circumferential portion of the second groove processing portion.

2. A groove processing method for processing a cylinder groove to an inner circumference of a cylinder, the cylinder groove protruding from an inner circumferential surface toward an outer circumferential surface side and extending in a direction of a center line of the cylinder, the method comprising:

moving a groove processing member in the direction of the center line while causing the groove processing member to contact the inner circumference of the cylinder, the groove processing member including two groove processing portions in a single body, each of which being formed to be a chevron shape so that a center portion thereof in the circumferential direction of the cylinder protrudes, and an inclination angle from a vertex portion in one of the groove processing portions is smaller than an inclination angle from a vertex portion in the other one of the groove processing portions.

* * * * *